US009662697B2

(12) United States Patent
Tachibana

(10) Patent No.: US 9,662,697 B2
(45) Date of Patent: May 30, 2017

(54) TAKE-UP DEVICE FOR STRIP

(71) Applicant: TOSHIBA MITSUBISHI-ELECTRIC INDUSTRIAL SYSTEMS CORPORATION, Chuo-ku (JP)

(72) Inventor: Minoru Tachibana, Tokyo (JP)

(73) Assignee: TOSHIBA MITSUBISHI-ELECTRIC INDUSTRIAL SYSTEMS CORPORATION, Chuo-ku (JP)

( * ) Notice: Subject to any disclaimer, the term of this patent is extended or adjusted under 35 U.S.C. 154(b) by 99 days.

(21) Appl. No.: 14/437,287

(22) PCT Filed: Nov. 28, 2012

(86) PCT No.: PCT/JP2012/080724

§ 371 (c)(1),
(2) Date: Apr. 21, 2015

(87) PCT Pub. No.: WO2014/083632

PCT Pub. Date: Jun. 5, 2014

(65) Prior Publication Data

US 2015/0266072 A1 Sep. 24, 2015

(51) Int. Cl.

| | |
|---|---|
| ***B21C 47/30*** | (2006.01) |
| ***B21C 47/06*** | (2006.01) |
| ***B21C 47/04*** | (2006.01) |

(52) U.S. Cl.

CPC ..... *B21C 47/063* (2013.01); *B21C 47/04* (2013.01); *B21C 47/30* (2013.01)

(58) Field of Classification Search

CPC ..... B21C 47/30; B21C 47/063

(Continued)

(56) References Cited

U.S. PATENT DOCUMENTS 7,523,886 B2 * 4/2009 Kim ..... B21C 47/30 242/571.3
2010/0192654 A1 * 8/2010 Tachibana ..... B21B 37/16 72/12.7

FOREIGN PATENT DOCUMENTS

JP 60-124417 7/1985
JP 01-224115 9/1989

(Continued)

OTHER PUBLICATIONS

English translation of the International Preliminary Report on Patentability and Written Opinion issued on Jun. 11, 2015 in PCT/JP 2012/080724 filed Nov. 28, 2012.

(Continued)

*Primary Examiner* — Sang Kim
(74) *Attorney, Agent, or Firm* — Oblon, McClelland, Maier & Neustadt, L.L.P.

(57) ABSTRACT

A take-up device includes a fluid-pressure device, a pressure detection device, a pressure calculation mechanism, and a controller. The fluid-pressure device is a device for expanding and contracting a mandrel. The pressure detection device detects a pressure of a hydraulic fluid in the fluid-pressure device. The pressure calculation mechanism calculates a tightening pressure acting on the mandrel, based on the pressure detected by the pressure detection device. The controller controls the fluid-pressure device. Also, the controller performs position control until the number of turns of a strip reaches a value. The controller performs constant-pressure control after the number of turns of the strip reaches the value.

4 Claims, 5 Drawing Sheets

No. 15 CONTROL DEVICE
No. 18 PRESSURE CALCULATION MEANS
No. 19 TIME CALCULATION MEANS
No. 20 TURN COUNT CALCULATION MEANS
No. 21 DIAMETER CALCULATION MEANS
No. 22 CONTROL MEANS
No. 23 STORAGE MEANS

(58) Field of Classification Search
USPC ..... 242/571, 529
See application file for complete search history.

(56) References Cited

FOREIGN PATENT DOCUMENTS

| | | |
|---|---|---|
| JP | 06-142759 | 5/1994 |
| JP | 07-136717 | 5/1995 |
| JP | 09-285817 | 11/1997 |

OTHER PUBLICATIONS

Combined Office Action and Search Report issued Jan. 5, 2016 in Chinese Patent Application No. 201280077342.2 (with Partial English language translation and English translation of Categories of Cited Documents).
International Search Report issued Jan. 15, 2013 in PCT/JP2012/080724 filed Nov. 28, 2012.
Office Action issued Apr. 11, 2016 in Korean Patent Application No. 10-2015-7011239 (with Partial English translation).
Office Action issued Apr. 12, 2016 in Japanese Patent Application No. 2014-549684 (with Partial English translation).

* cited by examiner

No. 15 CONTROL DEVICE
No. 18 PRESSURE CALCULATION MEANS
No. 19 TIME CALCULATION MEANS
No. 20 TURN COUNT CALCULATION MEANS
No. 21 DIAMETER CALCULATION MEANS
No. 22 CONTROL MEANS
No. 23 STORAGE MEANS

TAKE-UP DEVICE FOR STRIP

TECHNICAL FIELD

This invention relates to a device for taking up a strip.

BACKGROUND ART

Hot rolling lines include a device for taking up a strip. The strip is wrapped around a mandrel of the take-up device.

Upon a start of take-up of a strip, a tensile force acts on the strip. The tensile force imposes a force that further tightens the part of the strip wound on the mandrel, on the strip. A part of the strip that covers an outer side of a head thereof is strongly pressed against the head part, resulting in the problem of a mark of the head part (top mark) being left in the part that covers the outer side of the head.

Patent Literature 1 discloses a device for taking up a strip. Patent Literature 1 proposes a technique for preventing appearance of a top mark when a strip is taken up.

CITATION LIST

Patent Literature

Patent Literature 1: Japanese Patent Laid-Open No. 7-136717

SUMMARY OF INVENTION

Technical Problem

The device described in Patent Literature 1 controls a diameter of a mandrel according to a deformation resistance of a strip. This control method may cause slack when taking up the strip.

This invention has been made to solve problems such as mentioned above. An object of this invention is to provide a take-up device that prevents appearance of a top mark and occurrence of slack when taking up a strip on a rolling line.

Solution to Problem

An take-up device for a strip of the present invention is a device which comprises a mandrel for taking up the strip, a fluid-pressure device for expanding and contracting the mandrel, a pressure detection device that detects a pressure of a hydraulic fluid in the fluid-pressure device, pressure calculation means for calculating a tightening pressure acting on the mandrel, based on the pressure detected by the pressure detection device, storage means for storing a first reference turn count, and control means for controlling the fluid-pressure device. The control means performs position control for expanding the mandrel according to a number of turns of the strip until the number of turns of the strip reaches the first reference turn count. The control means performs constant-pressure control for making the tightening pressure calculated by the pressure calculation means constant after the number of turns of the strip reaches the first reference turn count.

Advantageous Effect of Invention

The take-up device according to this invention enables prevention of appearance of a top mark and occurrence of slack when taking up a strip on a rolling line.

DESCRIPTION OF EMBODIMENT

Figure 1:
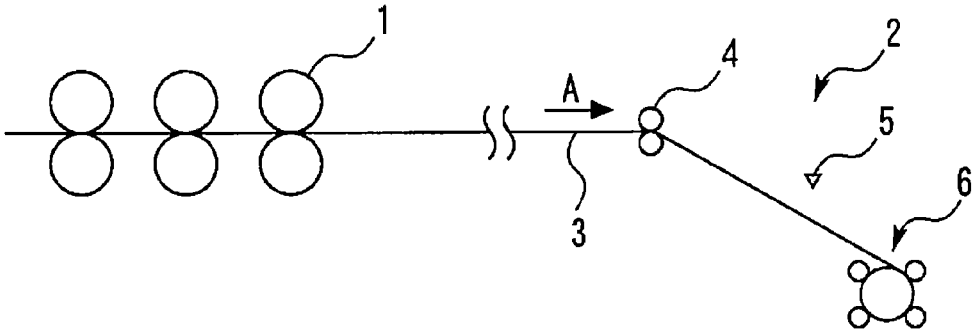
FIG. 1 is a diagram illustrating a main part of a rolling line including a take-up device according to Embodiment 1 of this invention.

The present invention will be described in detail with reference to the accompanying drawings. In each of the drawings, identical reference numerals refer to identical or corresponding parts. Redundant descriptions are appropriately simplified or omitted.

Embodiment 1

FIG. 1 is a diagram illustrating a main part of a rolling line including a take-up device according to Embodiment 1 of this invention. FIG. 1 illustrates a hot rolling line as an example of the rolling line.

The hot rolling line includes a finishing rolling mill 1 and a take-up device 2.

The take-up device 2 is a device for taking up a strip 3 (hot-rolled steel plate) rolled by the finishing rolling mill 1. In FIG. 1, illustration of a run-out table installed on the upstream side of the take-up device 2 is omitted. Arrow A in FIG. 1 indicates a direction of transport of the strip 3.

Figure 2:
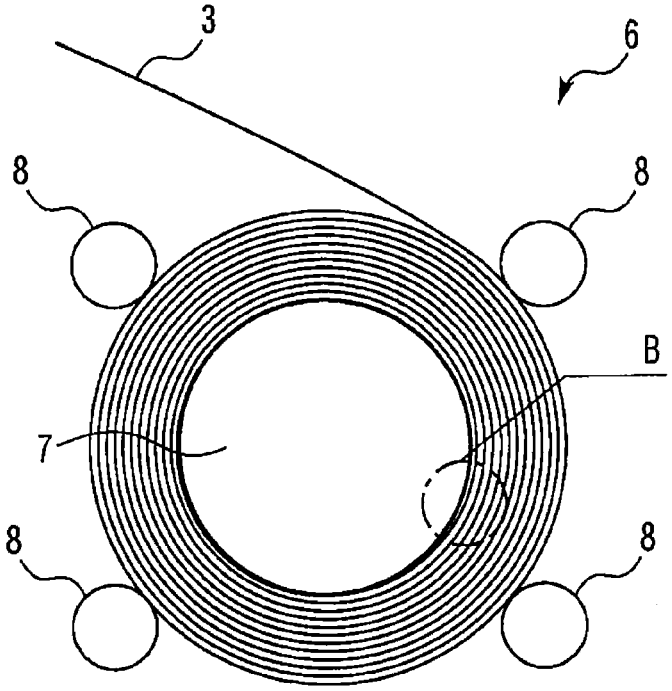
FIG. 2 is a diagram illustrating a main part of the take-up device according to Embodiment 1 of this invention.
Figure 3:
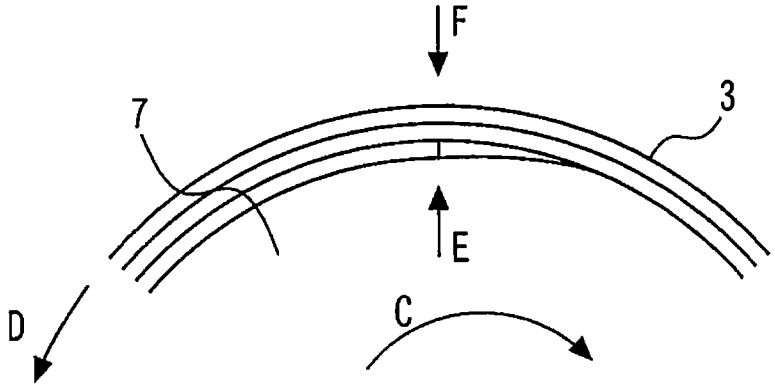
FIG. 3 is a an enlarged view of Part B in FIG. 2.
Figure 4:
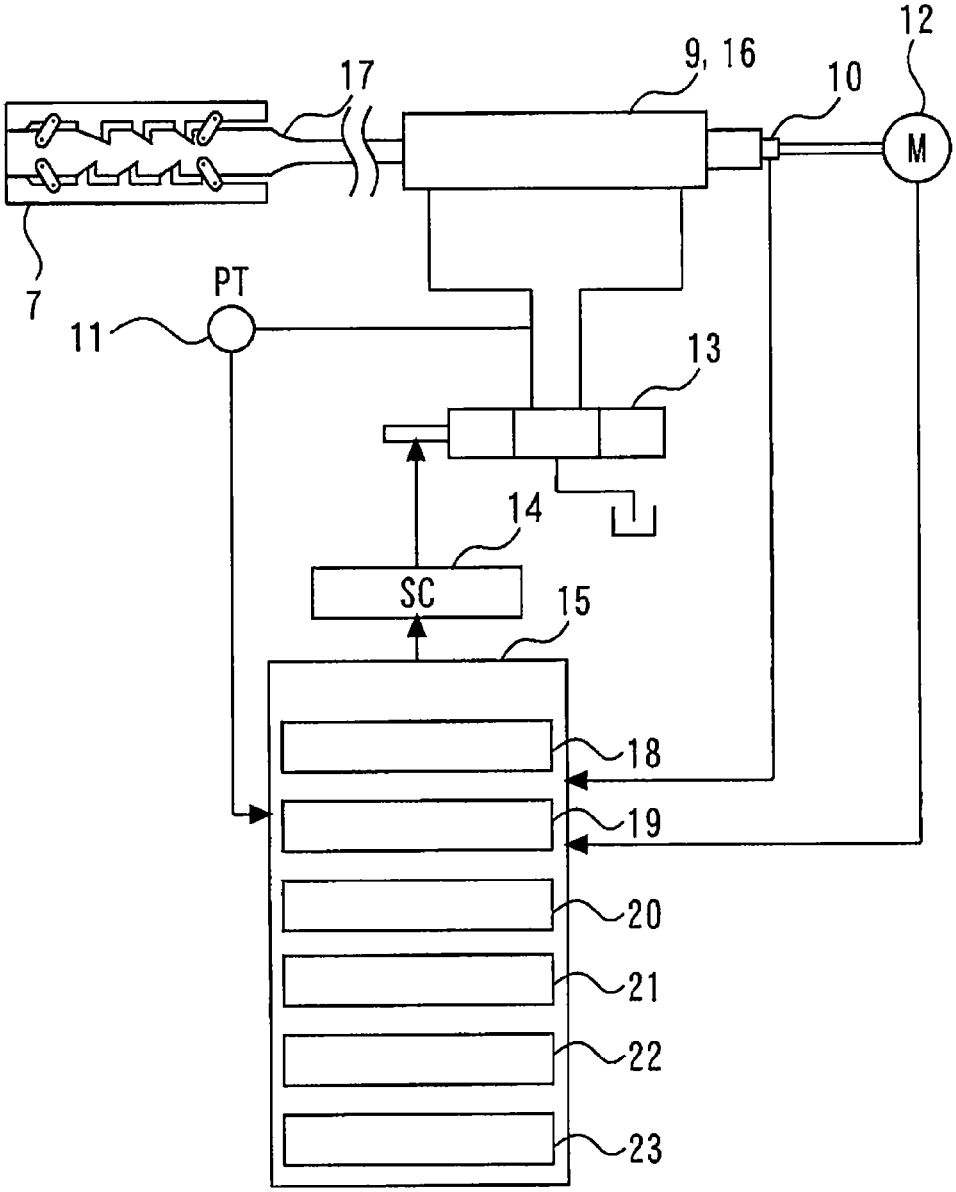
FIG. 4 is a diagram illustrating details of the take-up device according to Embodiment 1 of this invention.

FIG. 2 is a diagram illustrating a main part of the take-up device 2. FIG. 3 is an enlarged view of Part B in FIG. 2. FIG. 4 is a diagram illustrating details of the take-up device 2.

The take-up device 2 includes pinch rolls 4, a head detection device 5 and a coiler 6.

The pinch rolls 4 are rolls for bending the strip 3 before the strip 3 reaches the coiler 6, in order to take up the strip 3 by means of the coiler 6. The pinch rolls 4 are installed on the upstream side of the coiler 6.

The head detection device 5 is a device for detecting that a head of the strip 3 reaches a detection position. The head detection device 5 includes, for example, a laser sensor. The detection position of the head detection device 5 is set at a predetermined position between the pinch rolls 4 and the coiler 6.

The coiler 6 is a device for taking up the strip 3. The coiler 6 includes, for example, a mandrel 7, unit rolls 8, a fluid-pressure device 9, a position detection device 10, a pressure detection device 11, a motor 12, a servo valve 13, a servo controller 14 and a control device 15.

A mandrel 7 is a part that actually takes up the strip 3 rolled by the finishing rolling mill 1. The mandrel 7 includes a hollow rotation shaft and segments. Each segment is provided at the hollow rotation shaft so that the segment is radially movable. That is, upon movement of the segments, the mandrel 7 expands so as to increase a diameter thereof and contracts so as to decrease the diameter thereof.

The unit rolls 8 are rolls for assisting the take-up of the strip 3. The unit rolls 8 are arranged in parallel with the mandrel 7 so as to face the mandrel 7. The unit rolls 8 guide a surface of the strip 3 that faces the outside when taking up the strip 3 on the mandrel 7. The unit rolls 8 are installed around the mandrel 7. FIG. 2 illustrates an example in which four unit rolls 8 are arranged around the mandrel 7.

The fluid-pressure device 9 is a device for expanding and contacting the mandrel 7. The fluid-pressure device 9 includes, for example, a hydraulic power unit. The fluid-pressure device 9 includes a cylinder 16 and a piston 17. The piston 17, upon receipt of power from a hydraulic fluid, moves relative to the cylinder 16. The mandrel 7 expands or contracts as a result of the variation in position of the piston 17. In the example illustrated in FIG. 4, upon the piston 17 moving to the right side, the mandrel 7 expands radially. Upon the piston 17 moving to the left side, the mandrel 7 contracts radially.

The position detection device 10 detects the position of the piston 17 in the fluid-pressure device 9. Information on the position detected by the position detection device 10 is input to the control device 15.

The pressure detection device 11 detects a pressure of the hydraulic fluid in the fluid-pressure device 9. Information on the pressure detected by the pressure detection device 11 is input to the control device 15.

The motor 12 is a device for rotating the mandrel 7 when taking up the strip 3. The motor 12 includes a current detection device (not illustrated). The current detection device detects current supplied to the motor 12. Information on the current detected by the current detection device is input to the control device 15.

The servo controller 14 controls the servo valve 13. The control device 15 outputs an operational instruction to the servo controller 14. That is, the servo controller 14 controls the servo valve 13 based on the operational instruction input from the control device 15 to make the fluid-pressure device 9 operate properly. The control device 15 includes, for example, a PLC (programmable logic controller).

The control device 15 includes pressure calculation means 18, time calculation means 19, turn count calculation means 20, diameter calculation means 21, control means 22 and storage means 23. Each of the means 18 to 23 is a function of the control device 15, which is illustrated in a block.

The pressure calculation means 18 calculates a tightening pressure acting on the mandrel 7. As illustrated in FIG. 3, the mandrel 7 rotates in the direction indicated by C, whereby take-up of strip 3 is started. Upon the start of the take-up of the strip 3, a tensile force D acts on the strip 3. Also, upon the start of the take-up of the strip 3, control for expanding the mandrel 7 is performed. Thus, an expansion force E of the mandrel 7 acts on the strip 3.

As a result of the tensile force D and the expansion force E acting on the strip 3, a tightening force F acts on the mandrel 7. The pressure calculation means 18 calculates a current tightening pressure that the mandrel 7 is receiving from the strip 3. The pressure calculation means 18 performs the calculation based on the pressure detected by the pressure detection device 11.

The time calculation means 19 calculates time to be consumed until the start of the take-up of the strip 3. When the head of the strip 3 reaches the detection position, the head detection device 5 outputs a detection signal to the control device 15. Also, a speed of transport of the strip 3 is controlled by another control device, which is not illustrated. Information on the speed of transport of the strip 3 is input from such other control device to the control device 15. The time calculation means 19 calculates time expected to be consumed until the head of the strip 3 reaches a take-up position on the mandrel 7, based on a result of the detection of the head detection device 5 and the speed of transport of the strip 3.

The turn count calculation means 20 calculates the number of times the strip 3 is wound around the mandrel 7 (hereinafter referred to as the "number of turns of the strip 3"). The turn count calculation means 20 calculates the current number of turns of the strip 3 based on a timing when the head of the strip 3 reaches the take-up position on the mandrel 7 and the speed of transport of the strip 3. The timing can be calculated using, for example, a result of the calculation by the time calculation means 19.

The diameter calculation means 21 calculates the diameter of the mandrel 7. As described above, the mandrel 7 is expanded and contracted by the fluid-pressure device 9. The diameter calculation means 21 calculates the current diameter of the mandrel 7 based on the position of the piston 17 detected by the position detection device 10.

The control means 22 controls the fluid-pressure device 9. That is, the control means 22 outputs an operational instruction to the servo controller 14 to make the fluid-pressure device 9 operate properly. The control means 22 performs the control of the fluid-pressure device 9 based on results of calculation by the respective means indicated by reference numerals 18 to 21.

Information necessary for the control means 22 to control the fluid-pressure device 9 is stored in the storage means 23. For example, information relating to the number of turns of the strip 3 is stored in the storage means 23. Also, information relating to the tightening pressure is stored in the storage means 23. Information relating to the diameter of the mandrel 7 is stored in the storage means 23.

Figure 5:
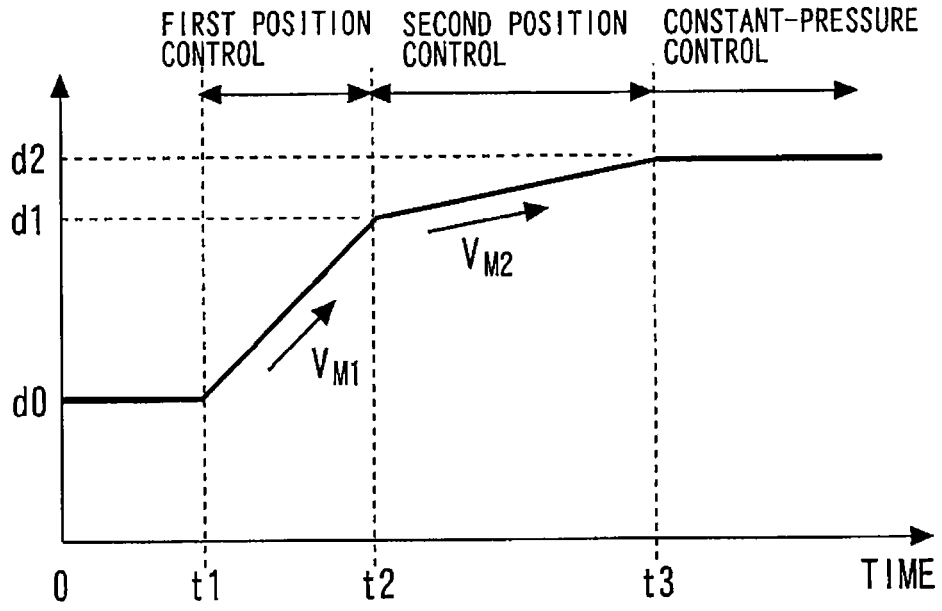
FIG. 5 is a diagram for describing functions of a control device illustrated in FIG. 4.

FIG. 5 is a diagram for describing functions of the control device 15 illustrated in FIG. 4. A time 0 in FIG. 5 represents a time when take-up of the strip 3 is started.

As illustrated in FIG. 5, as the information relating to the diameter of the mandrel 7, a standby diameter d0, a primary diameter d1 and a secondary diameter d2 are stored in the control device 15. The standby diameter d0 is a diameter of the mandrel 7 when take-up of the strip 3 starts. The primary diameter d1 is a diameter that is larger than the standby diameter d0 by $\alpha$ ($\alpha>0$). The secondary diameter d2 is a diameter that is larger than the stand-by diameter d0 by $\beta$ ($\beta>\alpha$).

Upon a start of take-up of the strip 3, the control device 15 basically performs the following control for the fluid-pressure device 9.

The control device 15 performs control to maintain the diameter of the mandrel 7 at the standby diameter d0 during a period from the time 0 to a time t1. The control device 15 performs first position control during a period from the time t1 to a time t2. The control device 15 performs second position control during a period from the time t2 to a time t3. After the time t3, the control device 15 performs constant-pressure control.

The times t1, t2 and t3 for the control device 15 to make control switching are set based on the number of turns of the strip 3. That is, the control device 15 performs the aforementioned control switching based on the number of times the strip 3 is wound around the mandrel 7. Thus, as the information relating to the number of turns of the strip 3, a turn count w1, a turn count w2 (w2>w1), a turn count w3 (w3>w2) are stored in the control device 15. The time t1 is a time when the number of turns of the strip 3 reaches w1. The time t2 is a time when the number of turns of the strip 3 reaches w2. The time t3 is a time when the number of turns of the strip 3 reaches w3.

Each of the first position control and the second position control is control for making the diameter of the mandrel 7 follow a target value. The target value is set in advance. For example, the control device 15 performs the first position control to expand the diameter of the mandrel 7 at a constant speed $V_{M1}$ during a period in which the number of turns of the strip 3 changes from w1 to w2. The control device 15 performs the second position control to expand the diameter of the mandrel 7 at a constant speed $V_{M2}$ ($V_{M2}<V_{M1}$) during a period in which the number of turns of the strip 3 changes from w2 to w3.

In the position control, the expansion speed $V_{M1}$ and the expansion speed $V_{M2}$ are set according to a thickness of the strip 3. For example, when taking up a thin strip 3, each of the expansion speeds $V_{M1}$ and $V_{M2}$ is set to a value that is smaller than those of cases of taking up a thick strip 3.

The constant-pressure control is control for making the tightening pressure acting on the mandrel 7 constant. A target value for making the tightening pressure constant is set in advance or set by a time when the constant-pressure control is started. For example, the control device 15 performs constant-pressure control to make the tightening pressure calculated by the pressure calculation means 18 constant after the number of turns of the strip 3 reaching w3.

Figure 6:
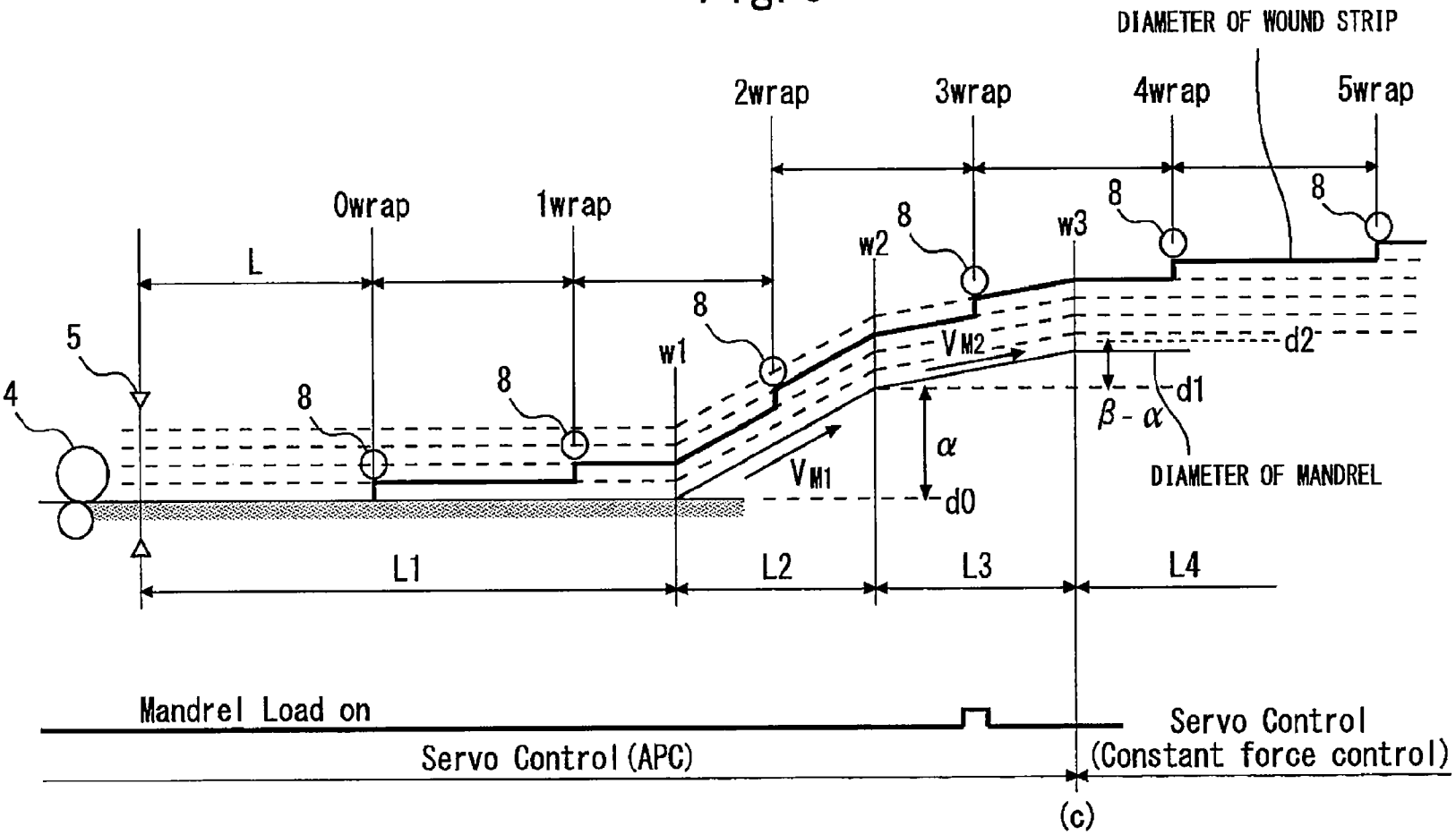
FIG. 6 is a diagram for describing an operation of the take-up device according to Embodiment 1 of this invention.

A specific operation of the take-up device 2 will be described below also with reference to FIG. 6. FIG. 6 is a diagram for describing an operation of the take-up device 2. FIG. 6 illustrates an example of an operation of the take-up device 2.

After passage through the pinch rolls 4, the strip 3 passes through the detection position of the head detection device 5 before reaching the coiler 6. Here, the head detection device 5 detects that the head of the strip 3 reaches the detection position. The control means 22 performs control to maintain the diameter of the mandrel 7 at the standby diameter d0 during a period in which the number of turns of the strip 3 reaches w1 after the detection of the arrival of the strip 3 by the head detection device 5. In FIG. 6, such period is indicated by L1.

During the period L1, the head of the strip 3 reaches the take-up position on the mandrel 7. The "0 wrap" illustrated in FIG. 6 indicates a time when take-up of the strip 3 is started. When take-up of the strip 3 is started, a gap that is slightly larger than the thickness of the strip 3 is formed between the unit rolls 8 and the mandrel 7.

The "1 wrap" illustrated in FIG. 6 indicates when a first turn of the strip 3 is completed. The unit rolls 8 moves outward before a second turn of the strip 3 is formed. Consequently, a gap that is slightly larger than the thickness of the strip 3 is formed between the part of the strip 3 wound around the mandrel 7 and the unit rolls 8. Each time a turn, that is, each of third, fourth . . . turns, of the strip 3 is formed, the unit rolls 8 move outward in a manner that is similar to the above.

When the number of turns of the strip 3 reaches w1, the control means 22 starts the first position control. The first position control is performed until the number of turns of the strip 3 reaches w2. In FIG. 6, a period in which the first position control is performed is indicated by L2. In the period L2, the control means 22 expands the diameter of the mandrel 7 at the constant speed $V_{M1}$. The control means 22 outputs an operational instruction to the servo controller 14 so that the diameter of the mandrel 7 reaches d1 when the number of turns of the strip 3 reaches w2.

When the number of turns of the strip 3 reaches w2, the control means 22 starts the second position control. The second position control is performed until the number of turns of the strip 3 reaches w3. In FIG. 6, a period in which the second position control is performed is indicated by L3. In the period L3, the control means 22 expands the diameter of the mandrel 7 at the constant speed $V_{M2}$. The control means 22 outputs an operational instruction to the servo controller 14 so that the diameter of the mandrel 7 reaches d2 when the number of turns of the strip 3 reaches w3.

When the number of turns of the strip 3 reaches w3, the control means 22 terminates the position control and starts the constant-pressure control. The constant-pressure control is continued after the number of turns of the strip 3 reaching w3. In FIG. 6, a period in which the constant-pressure control is performed is indicated by L4. In the period L4, the control means 22 outputs an operational instruction to the servo controller 14 so that the tightening pressure acting on the mandrel 7 becomes constant. For example, the control means 22 sets the tightening pressure calculated by the pressure calculation means 18 when the number of turns of the strip 3 reaches w3, as a target pressure. The control means 22 controls the fluid-pressure device 9 so that the tightening pressure acting on the mandrel 7 becomes constant at the set target pressure.

Also, as a piece of the information relating to the tightening pressure, a target pressure p0 may be stored in advance in the storage means 23. In such case, the control means 22 controls the fluid-pressure device 9 so that the tightening pressure acting on the mandrel 7 becomes constant at the target pressure p0.

If the target pressure p0 is set in advance, the tightening pressure acting on the mandrel 7 may reach the target pressure p0 during the position control is being performed. Even before the number of turns of the strip 3 reaches w3, if the tightening pressure acting on the mandrel 7 reaches the target pressure p0, the control means 22 may terminate the position control and start the constant-pressure control at the time of the tightening pressure reaching the target pressure p0. In such case, the control means 22 makes the tightening pressure acting on the mandrel 7 constant at the target pressure p0 in the constant-pressure control.

When the number of turns of the strip 3 reaches w3, there may be cases where the tightening pressure acting on the mandrel 7 does not yet reach the target pressure p0. Even in such cases, if the tightening pressure at the time of the number of turns of the strip 3 reaching w3 is a value close to the target pressure p0, no particular problem occurs even through the constant-pressure control is started as it is. On the other hand, if the tightening pressure at the time of the number of turns of the strip 3 reaching w3 is a value that is considerably lower than the target pressure p0, third position control may be performed after the second position control and the constant-pressure control may subsequently be started.

The third position control is control for making the diameter of the mandrel 7 follow a target value. In order to perform the third position control, as a piece of the information relating to the diameter of the mandrel 7, a tertiary diameter d3 is stored in the storage means 23. The tertiary diameter d3 is a diameter that is larger than the standby diameter d0 by $\gamma$ ($\gamma>\beta$). Also, as a piece of the information relating to the number of turns of the strip 3, a turn count w4 (w4>w3) is stored in the storage means 23. As a piece of the information relating to the tightening pressure, a lower limit pressure p1 (p1<p0) is stored in the storage means 23.

If the tightening pressure at the time of the number of turns of the strip 3 reaching w3 is lower than the lower limit pressure p1, the control means 22 performs the third position control to expand the diameter of the mandrel 7 at a constant speed during a period in which the number of turns of the strip 3 changes from w3 to w4. In the third position control, the control means 22 outputs an operational instruction to the servo controller 14 so that the diameter of the mandrel 7 reaches d3 when the number of turns of the strip 3 reaches w4. As a result of the third position control being performed, the constant-pressure control can be started with the tightening pressure made close to the target pressure p0.

Embodiment 1 of this invention enables prevention of appearance of a top mark and occurrence of slack when taking up a strip 3 on a rolling line.

That is, in the take-up device 2, the position control is performed until the take-up of the strip 3 is stabilized. Thus, slack in the strip 3, which easily occurs in an early stage of take-up, can be prevented. Also, in the take-up device 2, the constant-pressure control is performed after the take-up of the strip 3 is stabilized. The mandrel 7 is prevented from excessive tightening pressure acting thereon, enabling suppression of appearance of a top mark.

INDUSTRIAL APPLICABILITY

This invention is applicable to devices for taking up a strip on a rolling line. This invention is also applicable to any of other lines such as not only hot rolling lines and cold rolling lines.

REFERENCE SIGNS LIST

1 finishing rolling mill
2 take-up device
3 strip
4 pinch roll
5 head detection device
6 coiler
7 mandrel
8 unit roll
9 fluid-pressure device
10 position detection device
11 pressure detection device
12 motor
13 servo valve
14 servo controller
15 control device
16 cylinder
17 piston
18 pressure calculation means
19 time calculation means
20 turn count calculation means
21 diameter calculation means
22 control means
23 storage means

The invention claimed is:

1. A take-up device for a strip, comprising:
a mandrel for taking up the strip;
a fluid-pressure device for expanding and contracting the mandrel,
a pressure detection device that detects a pressure of a hydraulic fluid in the fluid-pressure device;
a control device configured to
calculate a tightening pressure acting on the mandrel, based on the pressure detected by the pressure detection device,
store a first reference turn count, and
control the fluid-pressure device,
wherein the control device performs position control for expanding the mandrel according to a number of turns of the strip until the number of turns of the strip reaches the first reference turn count;
wherein the control device performs constant-pressure control for making the calculated tightening pressure constant after the number of turns of the strip reaches the first reference turn count,
wherein the control device stores a first reference pressure; and
wherein if the calculated tightening pressure reaches the first reference pressure before the number of turns of the strip reaches the first reference turn count, the control device starts the constant-pressure control before the number of turns of the strip reaches the first reference turn count.

2. The take-up device for a strip according to claim 1,
wherein if the calculated tightening pressure reaches the first reference pressure before the number of turns of the strip reaches the first reference turn count, the control device starts the constant-pressure control for making the calculated tightening pressure constant at the first reference pressure.

3. The take-up device for a strip according to claim 1,
wherein the control device stores a reference diameter, and a second reference pressure that is a pressure lower than the first reference pressure; and
wherein if the calculated tightening pressure is lower than the second reference pressure when the number of turns of the strip reaches the first reference turn count, the control device starts the constant-pressure control after position control for making the diameter of the mandrel reach the reference diameter.

4. A take-up device for a strip, comprising:
a mandrel for taking up the strip;
a fluid-pressure device for expanding and contracting the mandrel;
a pressure detection device that detects a pressure of a hydraulic fluid in the fluid-pressure device;
a control device configured to
calculate a tightening pressure acting on the mandrel, based on the pressure detected by the pressure detection device,
store a first reference turn count, and
control the fluid-pressure device,
wherein the control device performs position control for expanding the mandrel according to a number of turns of the strip until the number of turns of the strip reaches the first reference turn count;
wherein the control device performs constant-pressure control for making the calculated tightening pressure constant after the number of turns of the strip reaches the first reference turn count,
wherein the control device stores a second reference turn count that is a turn count smaller than the first reference turn count; and
wherein if expanding the mandrel in the position control, the control device makes a speed of expansion of the diameter of the mandrel after the number of turns of the strip reaches the second reference turn count, be smaller than a speed of expansion of the diameter of the mandrel before the number of turns of the strip reaches the second reference turn count.

* * * * *